US009564084B2

(12) United States Patent
Park

(10) Patent No.: US 9,564,084 B2
(45) Date of Patent: Feb. 7, 2017

(54) METHOD OF OPERATING AN ORGANIC LIGHT EMITTING DISPLAY DEVICE, AND ORGANIC LIGHT EMITTING DISPLAY DEVICE

(71) Applicant: Samsung Display Co., Ltd., Yongin, Gyeonggi-Do (KR)

(72) Inventor: Jong-Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 45 days.

(21) Appl. No.: 14/327,403

(22) Filed: Jul. 9, 2014

(65) Prior Publication Data

US 2015/0091950 A1 Apr. 2, 2015

(30) Foreign Application Priority Data

Oct. 1, 2013 (KR) ..... 10-2013-0117159

(51) Int. Cl.

*G09G 3/30* (2006.01)
*G09G 3/32* (2016.01)
*G09G 5/02* (2006.01)

(52) U.S. Cl.

CPC ..... *G09G 3/3291* (2013.01); *G09G 3/3208* (2013.01); *G09G 2300/0452* (2013.01); *G09G 2320/0242* (2013.01); *G09G 2320/0626* (2013.01); *G09G 2320/0673* (2013.01); *G09G 2340/06* (2013.01); *G09G 2360/16* (2013.01)

(58) Field of Classification Search

CPC ..... G09G 3/30; G09G 5/02; G09G 3/3291; G09G 3/3208
USPC ..... 345/76, 591
See application file for complete search history.

(56) References Cited

U.S. PATENT DOCUMENTS

2005/0140612 A1* 6/2005 Baek ..... G09G 3/2003 345/83
2006/0214942 A1* 9/2006 Tanase ..... G09G 3/2003 345/589
2006/0290831 A1* 12/2006 You ..... G09G 3/3607 349/56
2007/0242006 A1* 10/2007 Lin ..... G09G 3/3225 345/82
2008/0252797 A1* 10/2008 Hamer ..... G09G 3/3208 348/802

(Continued)

FOREIGN PATENT DOCUMENTS

KR 10-2013-0036676 A 4/2013
KR 10-2013-0052784 A 5/2013

(Continued)

*Primary Examiner* — Adam J Snyder
(74) *Attorney, Agent, or Firm* — Lewis Roca Rothgerber Christie LLP

(57) ABSTRACT

In a method of operating an organic light emitting display device, the organic light emitting display device including a red sub-pixel, a green sub-pixel, a blue sub-pixel and a white sub-pixel, the method includes: receiving input data; calculating an on-pixel ratio (OPR) representing a ratio of a driving amount of the input data to a maximum driving amount; adjusting at least one gamma voltage of a first gamma voltage for the red, green, and blue sub-pixels and a second gamma voltage for the white sub-pixel according to the calculated OPR; and displaying an image corresponding to the input data using the first and second gamma voltages.

18 Claims, 13 Drawing Sheets

(56) References Cited

U.S. PATENT DOCUMENTS

| | | | | |
|---|---|---|---|---|
| 2010/0039453 | A1* | 2/2010 | Chaji | G09G 3/3677 345/690 |
| 2010/0091030 | A1* | 4/2010 | Park | G09G 3/2003 345/589 |
| 2010/0103187 | A1* | 4/2010 | Linssen | G09G 3/2003 345/88 |
| 2010/0253664 | A1* | 10/2010 | Byun | G09G 3/3208 345/76 |
| 2011/0057950 | A1* | 3/2011 | Kim | G09G 5/02 345/602 |
| 2013/0257924 | A1* | 10/2013 | Hirashima | G09G 5/02 345/690 |
| 2014/0085170 | A1 | 3/2014 | Park et al. | |

FOREIGN PATENT DOCUMENTS

| | | | |
|---|---|---|---|
| KR | 10-2013-0061225 | A | 6/2013 |
| KR | 10-2014-0040912 | A | 4/2014 |

* cited by examiner

FIG. 6

GAMMA TABLE

| ON-PIXEL RATIO | GAMMA VOLTAGE DATA |
|---|---|
| 0% ~ 10% | GVD1 |
| 10% ~ 20% | GVD2 |
| 30% ~ 40% | GVD3 |
| ⋮ | ⋮ |

METHOD OF OPERATING AN ORGANIC LIGHT EMITTING DISPLAY DEVICE, AND ORGANIC LIGHT EMITTING DISPLAY DEVICE

CROSS REFERENCE TO RELATED APPLICATION

This application claims priority to and the benefit of Korean Patent Application No. 10-2013-0117159 filed on Oct. 1, 2013, the disclosure of which is hereby incorporated by reference herein in its entirety.

BACKGROUND

1. Field

Example embodiments of the present invention relate to organic light emitting display devices and methods of operating the organic light emitting display devices.

2. Description of the Related Art

An organic light emitting display device implemented using a red, green, and blue (RGB) independent deposition method may have various characteristics, such as relatively low power consumption and a relatively high contrast ratio (CR), and thus the RGB independent deposition method has been widely used. In the RGB independent deposition method, patterning for each color of light is performed using fine metal masks. However, the RGB independent deposition method may be difficult to apply to a large scale substrate due to precision problems in aligning the fine metal masks, and a mask sagging phenomenon that may occur as the size of masks increases.

A white organic light emitting diode-color filter (WOLED-CF) method using a white organic light emitting diode in conjunction with a color filter has received much attention in consideration of improving processability and yield. A white organic light emitting diode can be realized by forming a plurality of organic light emitting materials that respectively emit red, green, and blue colors in an organic light emitting layer or by forming complementary pairs of organic light emitting materials in an organic light emitting layer. However, in the WOLED-CF method, white light must be filtered through a color filter, and thus the optical transmittance is relatively low when compared to that of the RGB independent deposition method. In order to maximize the optical efficiency, an RGBW pixel structure including a white (W) sub-pixel having no color filter as well as RGB sub-pixels having color filters has been developed.

However, in an organic light emitting display device having the RGBW pixel structure, because a luminance of a W sub-pixel having no color filter is generally twice as high as a sum of luminances of RGB sub-pixels having color filters, a simultaneous contrast phenomenon, in which a pure color looks darker because of a bright white background, may occur. Further, because the organic light emitting display device having the RGBW pixel structure drives one sub-pixel per pixel when white light is emitted using the W sub-pixel, and drives three sub-pixels per pixel when the white light is emitted using the RGB sub-pixels, the luminance of the W sub-pixel may be different from the luminance of the RGB sub-pixels due to a loading effect according to a driving amount of the organic light emitting display device.

SUMMARY

Aspects of example embodiments provide a method of operating an organic light emitting display device including red, green, blue, and white sub-pixels.

Aspects of example embodiments provide an organic light emitting display device including red, green, blue, and white sub-pixels.

According to aspects of example embodiments, there is provided a method of operating an organic light emitting display device including a red sub-pixel, a green sub-pixel, a blue sub-pixel, and a white sub-pixel, the method including: receiving input data; calculating an on-pixel ratio (OPR) representing a ratio of a driving amount of the input data to a maximum driving amount; adjusting at least one gamma voltage of a first gamma voltage for the red, green, and blue sub-pixels and a second gamma voltage for the white sub-pixel according to the calculated OPR; and displaying an image corresponding to the input data using the first and second gamma voltages.

The at least one gamma voltage may be adjusted such that the red, green, and blue sub-pixels and the white sub-pixel have a same luminance for a same gray level at the calculated OPR.

As the OPR increases, the first gamma voltage may be decreased, and as the OPR decreases, the first gamma voltage may be increased.

As the OPR increases, the second gamma voltage may be increased, and as the OPR decreases, the second gamma voltage may be decreased.

As the OPR increases, the first gamma voltage may be decreased, and the second gamma voltage may be increased, and as the OPR decreases, the first gamma voltage may be increased, and the second gamma voltage may be decreased.

Adjusting the at least one gamma voltage may include: storing a plurality of gamma voltage data respectively corresponding to a plurality of sections by dividing a range of the OPR into the plurality of sections; selecting one gamma voltage data corresponding to one of the sections to which the calculated OPR belongs from among the plurality of gamma voltage data; and generating a gamma voltage corresponding to the selected one gamma voltage data as the adjusted at least one gamma voltage.

The OPR of the input data may be calculated per frame.

Displaying the image corresponding to the input data may include: converting the input data into RGBW data including RGB data for the red, green, and blue sub-pixels and W data for the white sub-pixel; driving the red, green, and blue sub-pixels according to the RGB data based on the first gamma voltage; and driving the white sub-pixel according to the W data based on the second gamma voltage.

Converting the input data into the RGBW data may include: adjusting a ratio of the RGB data to the W data with respect to a white portion of the input data based on a first accumulated driving amount of the red, green, and blue sub-pixels and a second accumulated driving amount of the white sub-pixel.

According to aspects of example embodiments, there is provided a method of operating an organic light emitting display device, the organic light emitting display device including a red sub-pixel, a green sub-pixel, a blue sub-pixel, and a white sub-pixel, the method including: receiving input data; calculating an on-pixel ratio (OPR) representing a ratio of a driving amount of the input data to a maximum driving amount; converting the input data into RGBW data including RGB data for the red, green, and blue sub-pixels and W data for the white sub-pixel; adjusting at least one data of the RGB data and the W data according to the calculated OPR; and displaying an image based on the RGB data and the W data.

The at least one data may be adjusted such that the red, green, and blue sub-pixels and the white sub-pixel have a same luminance for a same gray level at the calculated OPR.

As the OPR increases, the RGB data may be decreased.

As the OPR increases, the W data may be decreased.

The OPR of the input data may be calculated per frame.

According to aspects of example embodiments, there is provided an organic light emitting display device, including: a display panel including a red sub-pixel, a green sub-pixel, a blue sub-pixel, and a white sub-pixel; a data converter configured to receive input data, to convert the input data into RGBW data including RGB data for the red, green, and blue sub-pixels and W data for the white sub-pixel, and to calculate an on-pixel ratio (OPR) representing a ratio of a driving amount of the input data to a maximum driving amount; a gamma voltage generator configured to generate a first gamma voltage for the red, green, and blue sub-pixels and a second gamma voltage for the white sub-pixel, and to adjust at least one gamma voltage of the first gamma voltage and the second gamma voltage according to the calculated OPR; and a source driver configured to drive the red, green, blue, and white sub-pixels according to the RGBW data by using the first and second gamma voltages.

The gamma voltage generator may be configured to adjust the at least one gamma voltage such that the red, green, and blue sub-pixels and the white sub-pixel have a same luminance for a same gray level at the calculated OPR.

The gamma voltage generator may be configured to decrease the first gamma voltage as the OPR increases, and to increase the first gamma voltage as the OPR decreases.

The gamma voltage generator may be configured to increase the second gamma voltage as the OPR increases, and to decrease the second gamma voltage as the OPR decreases.

The gamma voltage generator may include: a gamma table configured to store a plurality of gamma voltage data respectively corresponding to a plurality of sections by dividing a range of the OPR into the plurality of sections, and wherein the gamma voltage generator is configured to identify one section to which the calculated OPR belongs among the plurality of sections, to read one gamma voltage data corresponding to the identified one section among the plurality of gamma voltage data from the gamma table, and to generate a gamma voltage corresponding to the read one gamma voltage data as the adjusted at least one gamma voltage.

BRIEF DESCRIPTION OF THE DRAWINGS

Aspects of example embodiments can be understood in more detail from the following description taken in conjunction with the accompanying drawings, in which:

FIG. 6 is a diagram illustrating an example of a gamma table included in an organic light emitting display device of FIG. 4.

DETAILED DESCRIPTION

Figure 1:
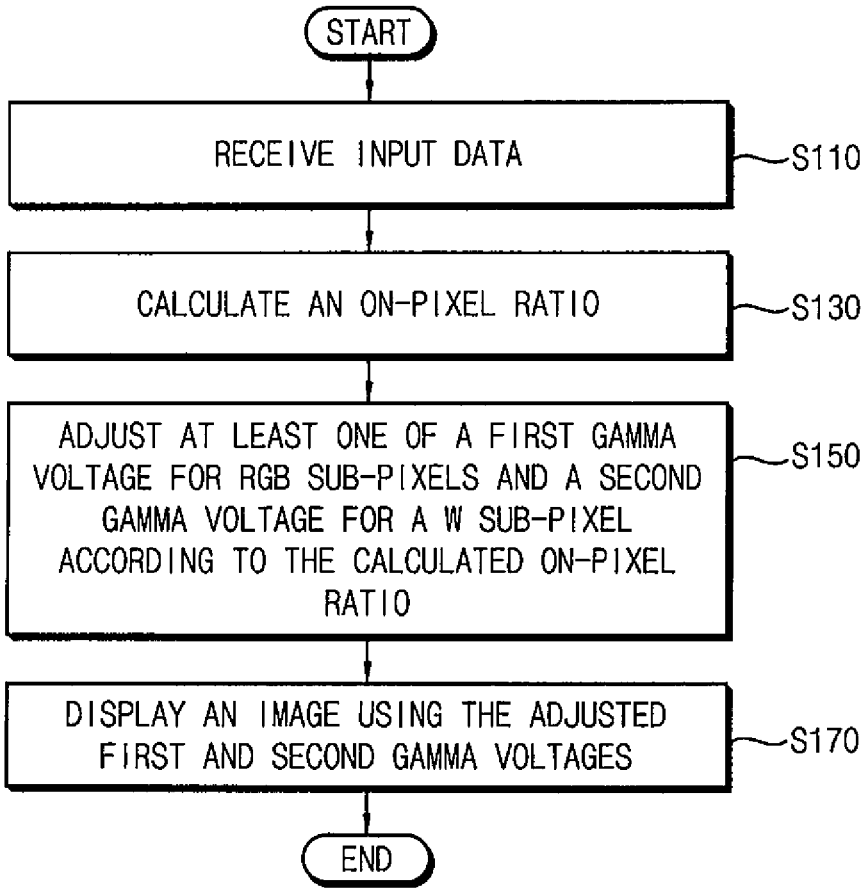
FIG. 1 is a flow chart illustrating a method of operating an organic light emitting display device including red, green, blue, and white sub-pixels in accordance with example embodiments.

Aspects of the example embodiments are described more fully hereinafter with reference to the accompanying drawings. The inventive concept may, however, be embodied in many different forms and should not be construed as limited to the example embodiments set forth herein. In the drawings, the relative sizes of layers, elements, and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of example embodiments of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2A:
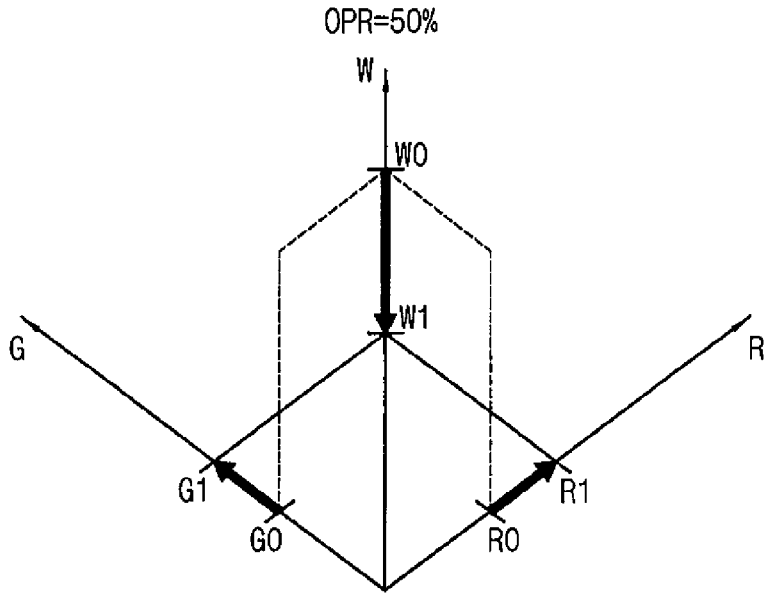
FIGS. 2A through 2C are diagrams for describing examples where gamma voltages are adjusted according to on-pixel ratios (OPRs) in a method of operating an organic light emitting display device in accordance with example embodiments.
Figure 2B:
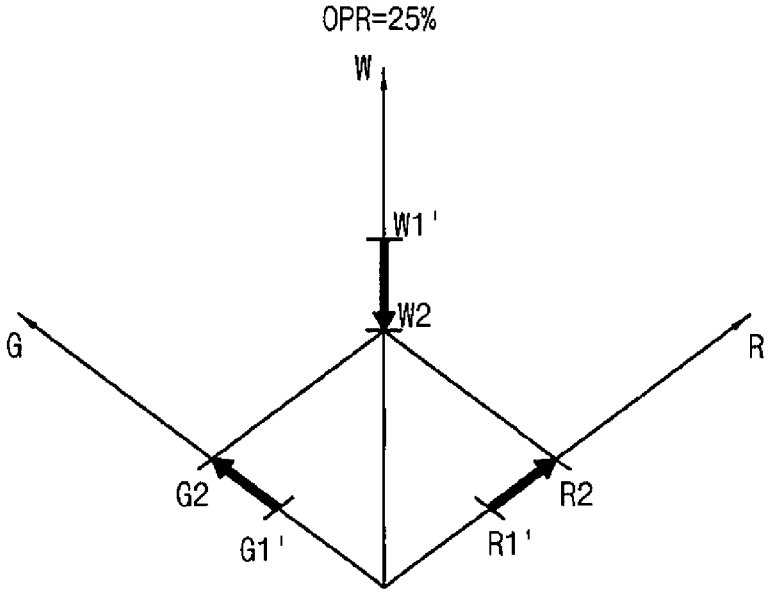
Figure 2C:
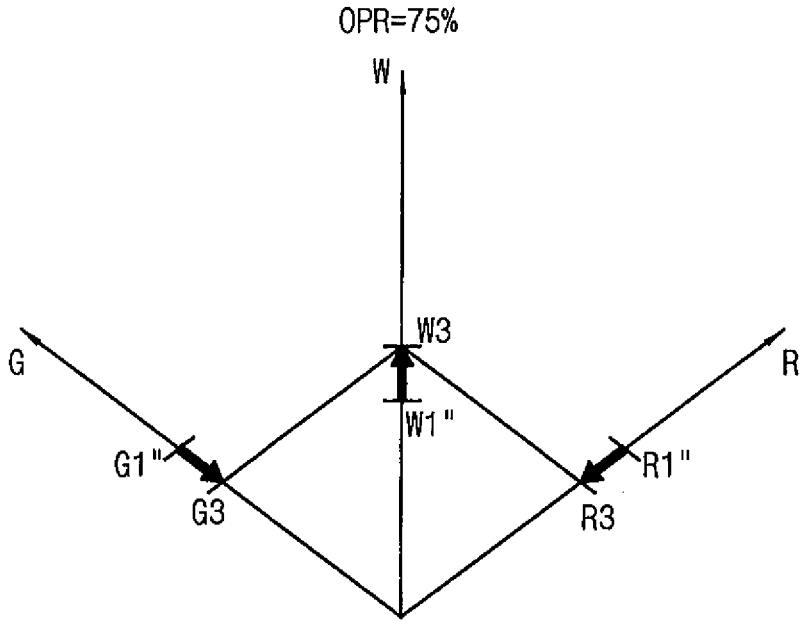
Figure 3A:
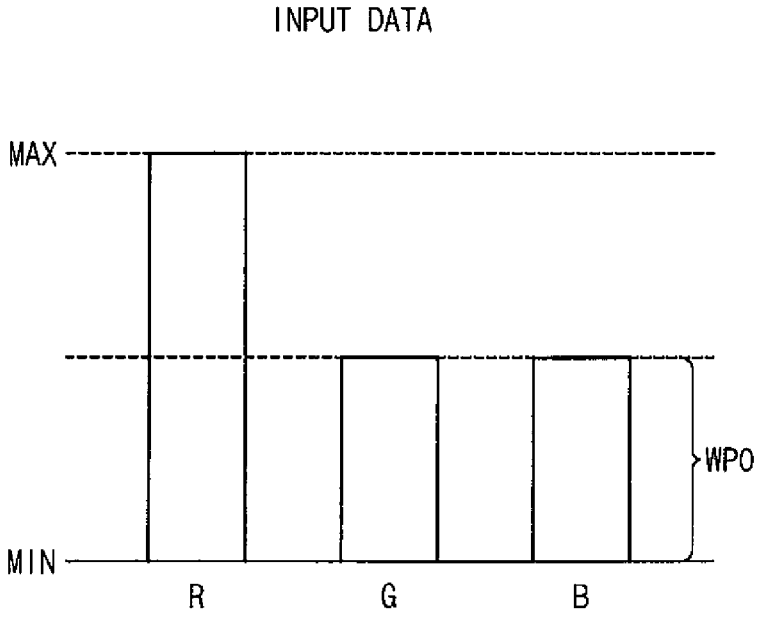
FIGS. 3A through 3D are diagrams for describing examples where input data are converted into RGBW data in a method of operating an organic light emitting display device in accordance with example embodiments.
Figure 3B:
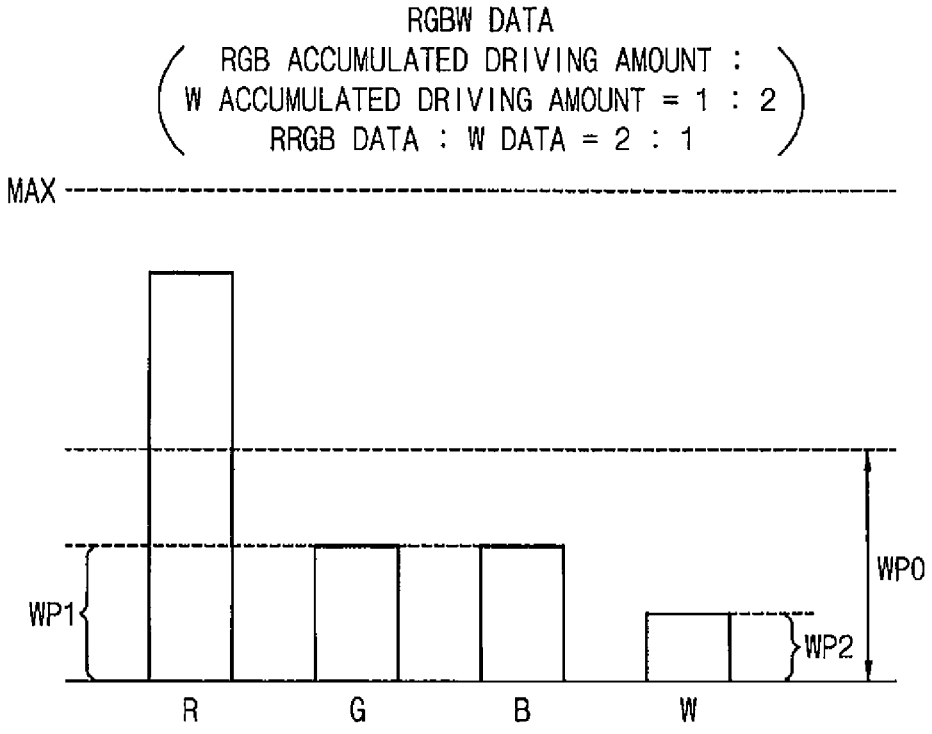
Figure 3C:
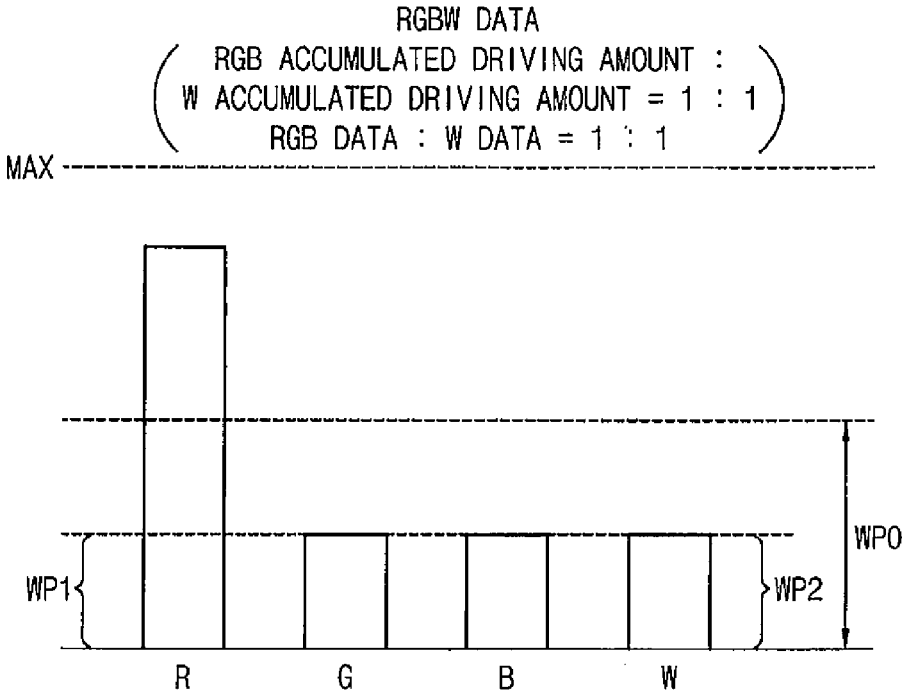

FIG. 1 is a flow chart illustrating a method of operating an organic light emitting display device including red, green, blue, and white sub-pixels in accordance with example embodiments. FIGS. 2A through 2C are diagrams for describing examples where gamma voltages are adjusted according to on-pixel ratios (OPRs) in a method of operating an organic light emitting display device in accordance with example embodiments. FIGS. 3A through 3C are diagrams for describing examples where input data are converted into RGBW data in a method of operating an organic light emitting display device in accordance with example embodiments.

Referring to FIG. 1, in a method of operating an organic light emitting display device including a white (W) sub-pixel as well as red, green, and blue (RGB) sub-pixels, the organic light emitting display device receives input data (S110), and calculates an on-pixel ratio (OPR) of the input data (S130). Here, the on-pixel ratio of the input data may represent a ratio of a driving amount of the input data to the maximum driving amount, or a driving amount when all pixels included in the organic light emitting display device are driven at the highest gray level. In some example embodiments, the on-pixel ratio of the input data may be calculated per frame of the input data, or on a frame-by-frame basis.

The organic light emitting display device adjusts at least one gamma voltage of a first gamma voltage for the RGB sub-pixels and a second gamma voltage for the W sub-pixel according to the calculated on-pixel ratio (S150). The at least one gamma voltage of the first gamma voltage and the second gamma voltage may be adjusted such that, at the calculated on-pixel ratio, the RGB sub-pixels and the W sub-pixel have substantially the same luminance for the same gray level (e.g., such that the RGB sub-pixels and the W sub-pixel have a luminance difference lower than about 10%).

In some example embodiments, to allow the RGB sub-pixels and the W sub-pixel to have substantially the same luminance for the same gray level, the first gamma voltage may be decreased and the second gamma voltage may be increased as the on-pixel ratio increases. Further, the first gamma voltage may be increased and the second gamma voltage may be decreased as the on-pixel ratio decreases.

For example, as illustrated in FIG. 2A, the first gamma voltage and the second gamma voltage may be set such that, at a reference on-pixel ratio (e.g., a predetermined on-pixel ratio), for example, of about 50%, the RGB sub-pixels and the W sub-pixel have substantially the same luminance for the same gray level. Generally, in an organic light emitting display device including RGBW sub-pixels, the luminance of the RGB sub-pixels (e.g., a vector sum of luminances R0 and G0 of the RGB sub-pixels) having color filters may be lower than the luminance W0 of the W sub-pixel having no color filter.

However, in the organic light emitting display device according to example embodiments, by increasing the first gamma voltage for the RGB sub-pixels and by decreasing the second gamma voltage for the W sub-pixel compared with those of a comparable organic light emitting display device, the luminance of the RGB sub-pixels (i.e., the vector sum of the luminances R1 and G1 of the RGB sub-pixels) may be substantially the same as the luminance W1 of the W sub-pixel for each gray level at the reference on-pixel ratio (e.g., a predetermined on-pixel ratio).

Accordingly, because luminances of respective pure colors represented by the RGB sub-pixels are increased, and luminance of a white color represented by the W sub-pixel is decreased, the organic light emitting display device according to example embodiments may prevent a simultaneous contrast phenomenon in which a pure color looks darker because of a bright white background. In some example embodiments, the first gamma voltage and the second gamma voltage, which are set such that the RGB sub-pixels and the W sub-pixel have substantially the same luminance for each gray level at the reference on-pixel ratio (e.g., a predetermined on-pixel ratio), may be stored in the form of a look-up table (e.g., a gamma table) in the organic light emitting display device.

However, even though the first and second gamma voltages are set such that the RGB sub-pixels and the W sub-pixel have substantially the same luminance at the reference on-pixel ratio (e.g., a predetermined on-pixel ratio), the luminance of the RGB sub-pixels and the luminance of the W sub-pixel may be changed or modified to have a different luminance due to a loading effect if the on-pixel ratio is changed. For example, because the organic light emitting display device drives one sub-pixel per pixel when white light is emitted using the W sub-pixel, and drives three sub-pixels per pixel when the white light is emitted using the RGB sub-pixels, the luminance of the RGB sub-pixels may be relatively decreased compared with the luminance of the W sub-pixel as the on-pixel ratio decreases, and the luminance of the W sub-pixel may be relatively decreased compared with the luminance of the RGB sub-pixels as the on-pixel ratio increases. Accordingly, to obviate such a luminance difference according to the on-pixel ratio, the method of operating the organic light emitting display device according to example embodiments may adjust at least one of the first gamma voltage for the RGB sub-pixels and the second gamma voltage for the W sub-pixel depending on the calculated on-pixel ratio.

For example, even though the luminance R1 and G1 of the RGB sub-pixels are substantially the same as the luminance W1 of the W sub-pixel at the reference on-pixel ratio (e.g., a predetermined on-pixel ratio), for example, of about 50%, as illustrated in FIG. 2B, the luminance R1' and G1' of the RGB sub-pixels may be relatively decreased compared with the luminance W1' of the W sub-pixel if the on-pixel ratio decreases (e.g., if the on-pixel ratio decreases from about 50% to about 25%). However, when the on-pixel ratio decreases (e.g., from about 50% to about 25%), the method of operating the organic light emitting display device according to example embodiments may increase the first gamma voltage for the RGB sub-pixels, and/or may decrease the second gamma voltage for the W sub-pixel such that the luminance R2, G2 of the RGB sub-pixels is substantially the same as the luminance W2 of the W sub-pixel. Accordingly, even if the on-pixel ratio is decreased, the method of operating the organic light emitting display device according to example embodiments may allow the RGB sub-pixels and the W sub-pixel to have substantially the same luminance at the decreased on-pixel ratio, thereby preventing or reducing the simultaneous contrast phenomenon and improving the image quality.

Further, for example, even though the luminance R1 and G1 of the RGB sub-pixels are substantially the same as the luminance W1 of the W sub-pixel at the reference on-pixel ratio (e.g., a predetermined on-pixel ratio), for example, of about 50%, as illustrated in FIG. 2C, the luminance W1" of the W sub-pixel may be relatively decreased compared with the luminance R1" and G1" of the RGB sub-pixels if the on-pixel ratio increases (e.g., if the on-pixel ratio increases from about 50% to about 75%). However, when the on-pixel ratio increases (e.g., from about 50% to about 75%), the method of operating the organic light emitting display device according to example embodiments may decrease the first gamma voltage for the RGB sub-pixels, and/or may increase the second gamma voltage for the W sub-pixel such that the luminance R3, G3 of the RGB sub-pixels is substantially the same as the luminance W3 of the W sub-pixel. Accordingly, even if the on-pixel ratio is increased, the method of operating the organic light emitting display device according to example embodiments may allow the RGB sub-pixels and the W sub-pixel to have substantially the same luminance at the increased on-pixel ratio, thereby preventing or reducing the simultaneous contrast phenomenon and improving the image quality.

Although examples where both of the first and second gamma voltages are adjusted according to the on-pixel ratio are illustrated in FIGS. 2A through 2C, either the first gamma voltage or the second gamma voltage may be adjusted according to the on-pixel ratio. In some example embodiments, the first gamma voltage may be decreased as the on-pixel ratio increases, and may be increased as the on-pixel ratio decreases. In other example embodiments, the second gamma voltage may be increased as the on-pixel ratio increases, and may be decreased as the on-pixel ratio decreases.

In some example embodiments, the adjustment of the at least one gamma voltage of the first and second gamma voltages may be performed using a gamma table. For example, a range (e.g., from about 0% to about 100%) of the on-pixel ratio may be divided into a plurality of sections, and a plurality of gamma voltage data respectively corresponding to the plurality of sections may be stored in the gamma table included in the organic light emitting display device. That is, the data about the at least one gamma voltage for allowing the RGB sub-pixels and the W sub-pixel to have substantially the same luminance for respective gray levels at each section of the on-pixel ratio may be stored in the gamma table. The organic light emitting display device may select, from among the plurality of gamma voltage data, one gamma voltage data corresponding to one of the sections to which the calculated on-pixel ratio belongs, and may generate a gamma voltage corresponding to the selected one gamma voltage data as the adjusted at least one gamma voltage. As described above, because the gamma voltage data for each section of the on-pixel ratio are previously stored, and the gamma voltage corresponding to the on-pixel ratio of the input data is generated using the previously stored gamma voltage data, the RGB sub-pixels and the W sub-pixel may have substantially the same luminance for each gray level even if the on-pixel ratio is changed.

The organic light emitting display device displays an image corresponding to the input data using the first and second gamma voltage of which at least one is adjusted according to the calculated on-pixel ratio (S170). For example, the organic light emitting display device may convert the input data into RGBW data including RGB data for the RGB sub-pixels and W data for the W sub-pixel, may drive the RGB sub-pixels according to the RGB data by using the first gamma voltage, and may drive the W sub-pixel according to the W data by using the second gamma voltage. Because the at least one of the first and second gamma voltages is adjusted according to the calculated on-pixel ratio of the input data, the RGB sub-pixels and the W sub-pixel may have substantially the same luminance, which may result in preventing or reducing the simultaneous contrast phenomenon and the improving the image quality.

In some example embodiments, when the input data are converted into the RGBW data, a ratio of the RGB data to the W data with respect to a white portion of the input data may be adjusted based on a first accumulated driving amount of the RGB sub-pixels and a second accumulated driving amount of the W sub-pixel. For example, the organic light emitting display device may calculate a ratio of the first accumulated driving amount of the RGB sub-pixels to the second accumulated driving amount of the W sub-pixel, and may determine the ratio of the RGB data to the W data with respect to the white portion of the input data in inverse proportion to the ratio of the first accumulated driving amount to the second accumulated driving amount.

For example, as illustrated in FIG. 3A, the organic light emitting display device may receive the input data having the white portion WP0. Here, the white portion WP0 may correspond to the minimum data among R data, G data and B data included in the input data. In a case where the ratio of the first accumulated driving amount of the RGB sub-pixels to the second accumulated driving amount of the W sub-pixel is 1:2 as illustrated in FIG. 3B, the organic light emitting display device may determine the ratio of the RGB data WP1 to the W data WP2 with respect to the white portion WP0 of the input data as a reciprocal number of the ratio of the first accumulated driving amount to the second accumulated driving amount, or as 2:1. Accordingly, the organic light emitting display device may convert the input data into RGBW data including R data, G data, and B data that are decreased by one third of the white portion WP0 from the input data, and further including W data WP2 corresponding to one third of the white portion WP0.

In a case where the ratio of the first accumulated driving amount of the RGB sub-pixels to the second accumulated driving amount of the W sub-pixel is 1:1 as illustrated in FIG. 3C, the organic light emitting display device may determine the ratio of RGB data WP1 to the W data WP2 with respect to the white portion WP0 of the input data as a reciprocal number of the ratio of the first accumulated driving amount to the second accumulated driving amount, or as 1:1. Accordingly, the organic light emitting display device may convert the input data into RGBW data including R data, G data, and B data that are decreased by a half of the white portion WP0 from the input data, and further including W data WP2 corresponding to a half of the white portion WP0.

Figure 3D:
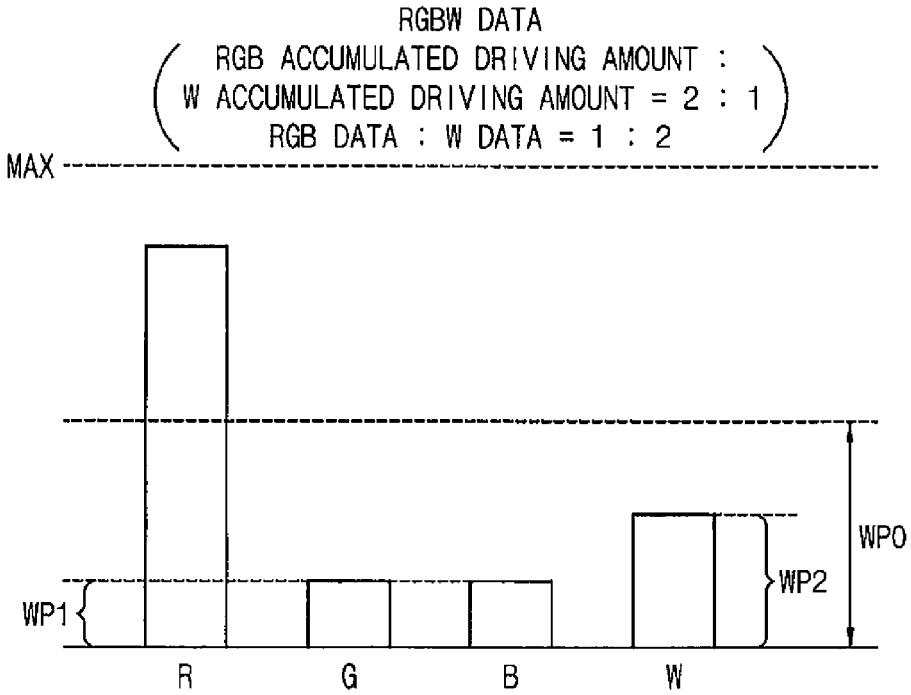

In a case where the ratio of the first accumulated driving amount of the RGB sub-pixels to the second accumulated driving amount of the W sub-pixel is 2:1 as illustrated in FIG. 3D, the organic light emitting display device may determine the ratio of the RGB data WP1 to the W data WP2 with respect to the white portion W0 of the input data as a reciprocal number of the ratio of the first accumulated driving amount to the second accumulated driving amount, or as 1:2. Accordingly, the organic light emitting display device may convert the input data into RGBW data including R data, G data, and B data that are decreased by two thirds of the white portion WP0 from the RGB input data, and further including W data WP2 corresponding to two thirds of the white portion WP0.

As described above, in some example embodiments, because the ratio of the RGB data to the W data is determined in inverse proportion to the ratio of the first accumulated driving amount of the RGB sub-pixels to the second accumulated driving amount of the W sub-pixel, a difference between the first accumulated driving amount of the RGB sub-pixels and the second accumulated driving amount of the W sub-pixel may be reduced. Accordingly, luminance degradation of the W sub-pixel may be similar to luminance degradation of the RGB sub-pixels. Thus, in some example embodiments, a lifetime of the W sub-pixel may be similar to a lifetime of each RGB sub-pixel, which may improve the lifetimes of the sub-pixels.

As described above, in the method of operating the organic light emitting display device according to example embodiments, the on-pixel ratio of the input data may be calculated per frame, at least one of the first gamma voltage for the RGB sub-pixels and the second gamma voltage for the W sub-pixel may be adjusted according to the calculated on-pixel ratio, and the image may be displayed using the adjusted first and second gamma voltages. Accordingly, even if the on-pixel ratio is changed, the method of operating the organic light emitting display device according to example embodiments may allow the RGB sub-pixels and the W sub-pixel to have substantially the same luminance at the changed on-pixel ratio, thereby preventing or reducing the simultaneous contrast phenomenon and improving the image quality.

Figure 4:
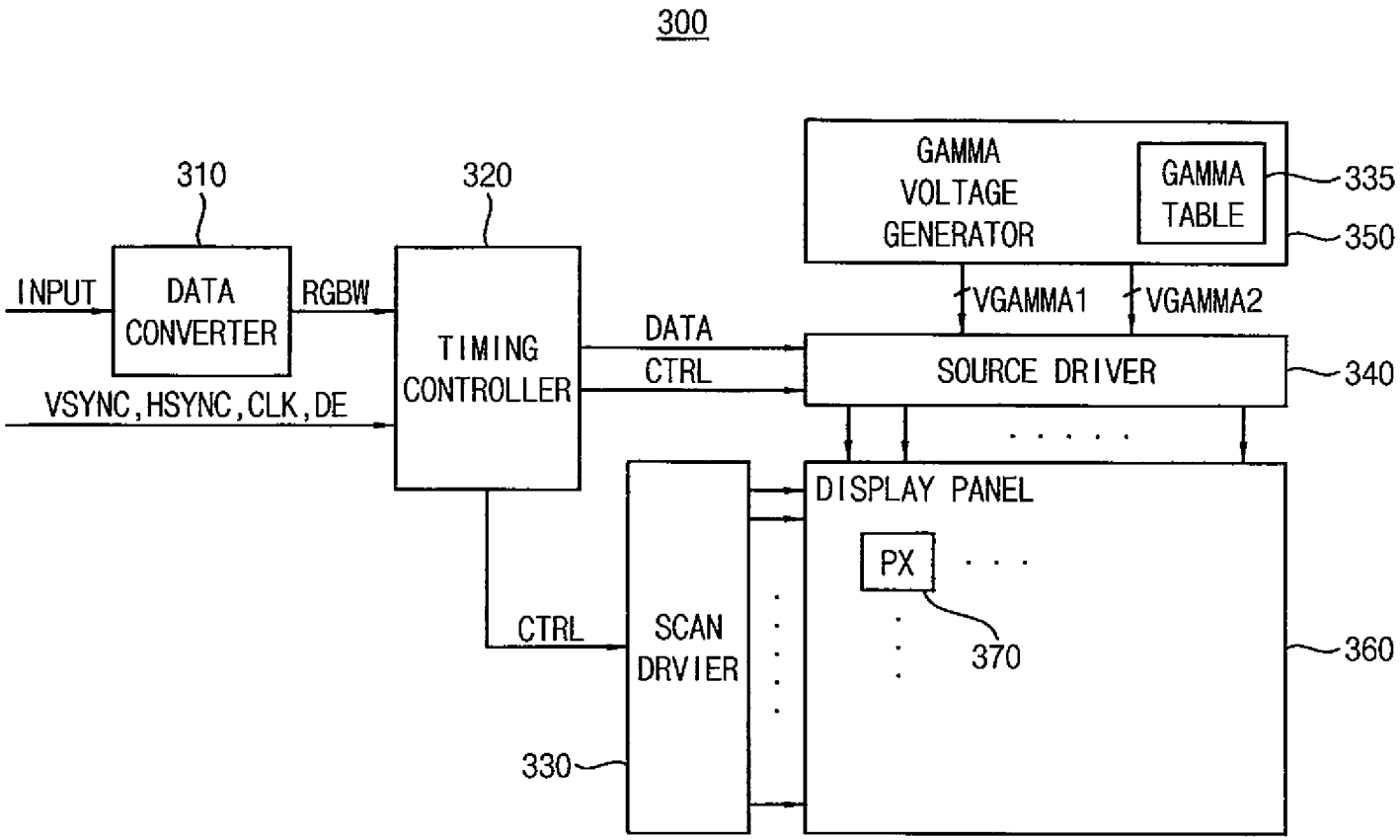
FIG. 4 is a block diagram illustrating an organic light emitting display device including red, green, blue, and white sub-pixels in accordance with example embodiments.
Figure 5A:
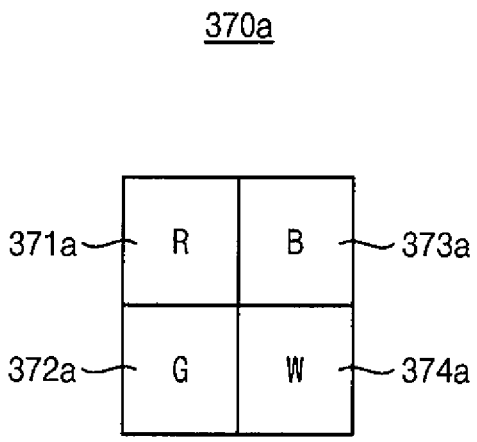
FIGS. 5A and 5B are diagrams illustrating examples of pixels included in an organic light emitting display device of FIG. 4.
Figure 5B:
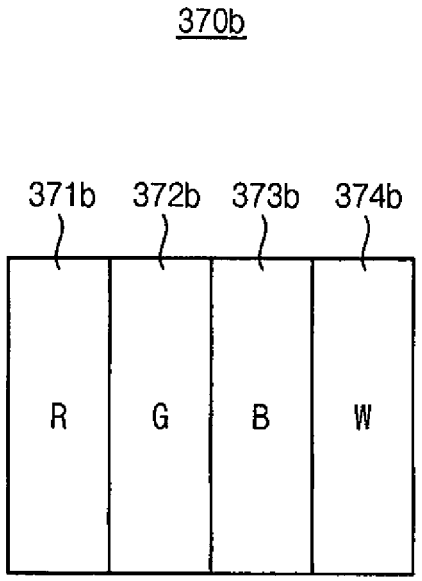

FIG. 4 is a block diagram illustrating an organic light emitting display device including red, green, blue, and white sub-pixels in accordance with example embodiments, FIGS. 5A and 5B are diagrams illustrating examples of pixels included in an organic light emitting display device of FIG. 4, and FIG. 6 is a diagram illustrating an example of a gamma table included in an organic light emitting display device of FIG. 4.

Referring to FIG. 4, an organic light emitting display device 300 includes a data converter 310, a timing controller 320, a scan driver 330, a source driver 340, a gamma voltage generator 350 and a display panel 360.

The display panel 360 may include a plurality of pixels (PX) 370 that are arranged in a matrix having a plurality of rows and a plurality of columns. Each pixel 370 may include an R sub-pixel, a G sub-pixel, a B sub-pixel, and a W sub-pixel. In some example embodiments, as illustrated in FIG. 5A, each pixel 370*a* may include an R sub-pixel 371*a*, a G sub-pixel 372*a*, a B sub-pixel 373*a*, and a W sub-pixel 374*a* that are arranged in a matrix having two rows and two columns. In other example embodiments, as illustrated in FIG. 5B, each pixel 370*b* may include an R sub-pixel 371*b*, a G sub-pixel 372*b*, a B sub-pixel 373*b*, and a W sub-pixel 374*b* that are arranged in one row. Further, in some example embodiments, the R sub-pixel 371*a* and 371*b* may include a white organic light emitting diode (OLED) and a red filter, the G sub-pixel 372*a* and 372*b* may include a white OLED and a green filter, the B sub-pixel 373*a* and 373*b* may include a white OLED and a blue filter, and the W sub-pixel 374*a* and 374*b* may include a white OLED without a color filter. In other example embodiments, all sub-pixels 371*a*, 371*b*, 372*a*, 372*b*, 373*a*, 373*b*, 374*a* and 374*b* may not include color filters, the R sub-pixel 371*a* and 371*b* may include a red OLED emitting red light, the G sub-pixel 372*a* and 372*b* may include a green OLED emitting green light, the B sub-pixel 373*a* and 373*b* may include a blue OLED emitting blue light, and the W sub-pixel 374*a* and 374*b* may include a white OLED emitting white light.

The data converter 310 may receive input data INPUT, and may convert the input data into RGBW data including RGB data and W data. Further, the data converter 310 may calculate an on-pixel ratio (OPR) representing a ratio of a driving amount of the input data INPUT to the maximum driving amount. In some example embodiments, the data converter 310 may calculate the on-pixel ratio of the input data on a frame-by-frame basis. Although an example where the data converter 310 is located outside the timing controller 320 is illustrated in FIG. 4, in some example embodiments, the data converter 310 may be located inside the timing controller 320.

The timing controller 320 may receive the RGBW data from the data converter 310, and may receive control signals VSYNC, HSYNC, CLK, and DE from a host device. For example, the control signals VSYNC, HSYNC, CLK, and DE may include a vertical synchronization signal VSYNC, a horizontal synchronization signal HSYNC, a clock signal CLK and a data enable signal DE. Based on the RGBW data and the control signals VSYNC, HSYNC, CLK, and DE, the timing controller 320 may generate image data DATA provided to the source driver 340 and a control signal CTRL provided to the scan driver 330 and the source driver 340. The timing controller 320 may provide the source driver 340 with the RGBW data received from the data converter 310 as the image data DATA.

The scan driver 330 and the source driver 340 may be controlled by the timing controller 320 to drive the display panel 360. For example, the scan driver 330 may turn on or off thin film transistors (TFTs) formed on the display panel 360. The source driver 340 may select a gamma voltage VGAMMA1 and VGAMMA2 generated by the gamma voltage generator 350 based on the image data DATA provided from the timing controller 320, and may apply, as a data voltage, the selected gamma voltage VGAMMA1 and VGAMMA2 to the display panel 360.

The gamma voltage generator 350 may generate a first gamma voltage VGAMMA1 for the RGB sub-pixels and a second gamma voltage VGAMMA2 for the W sub-pixel. In some example embodiments, the first gamma voltage VGAMMA1 may be commonly used for the RGB sub-pixels. In other example embodiments, the first gamma voltage VGAMMA1 may include a plurality of gamma voltages respectively used for the R sub-pixel, the G sub-pixel, and the B sub-pixel. The gamma voltage generator 350 may adjust at least one gamma voltage of the first gamma voltage VGAMMA1 and the second gamma voltage VGAMMA2 according to the on-pixel ratio of the input data calculated by the data converter 310. The gamma voltage generator 350 may adjust the at least one gamma voltage such that, at the calculated on-pixel ratio, the RGB sub-pixels and the W sub-pixel have substantially the same luminance for each gray level (e.g., such that the RGB sub-pixels and the W sub-pixel have a luminance difference lower than about 10%).

In some example embodiments, the gamma voltage generator 350 may decrease the first gamma voltage VGAMMA1 as the on-pixel ratio increases, and may increase the first gamma voltage VGAMMA1 as the on-pixel ratio decreases. In other example embodiments, the gamma voltage generator 350 may increase the second gamma voltage VGAMMA2 as the on-pixel ratio increases, and may decrease the second gamma voltage VGAMMA2 as the on-pixel ratio decreases. In still other example embodiments, the gamma voltage generator 350 may decrease the first gamma voltage VGAMMA1 and increase the second gamma voltage VGAMMA2 as the on-pixel ratio increases, and may increase the first gamma voltage VGAMMA1 and decrease the second gamma voltage VGAMMA2 as the on-pixel ratio decreases.

In some example embodiments, to provide the first and second gamma voltages VGAMMA1 and VGAMMA2 that are adjusted according to the calculated on-pixel ratio of the input data, the gamma voltage generator 350 may include a gamma table 335 that stores a plurality of gamma voltage data respectively corresponding to a plurality of sections by dividing a range of the on-pixel ratio into the plurality of sections. For example, as illustrated in FIG. 6, with respect to at least one of the first and second gamma voltages VGAMMA1 and VGAMMA2, the gamma table 335 may store first gamma voltage data GVD1 corresponding to the on-pixel ratio ranging from about 0% to about 10%, second gamma voltage data GVD2 corresponding to the on-pixel ratio ranging from about 10% to about 20%, third gamma voltage data GVD3 corresponding to the on-pixel ratio ranging from about 20% to about 30%, etc. The gamma voltage generator 350 may identify one section to which the calculated on-pixel ratio belongs among the plurality of sections, may read one gamma voltage data corresponding to the identified one section among the plurality of gamma voltage data GVD1, GVD2 and GVD3 from the gamma table 335, and may generate a gamma voltage corresponding to the read one gamma voltage data as the adjusted at least one gamma voltage. Accordingly, the gamma voltage generator 350 may generate the first gamma voltage VGAMMA1 and/or the second gamma voltage VGAMMA2 that are adjusted according to the calculated on-pixel ratio of the input data.

The source driver 340 may receive the first and second gamma voltages VGAMMA1 and VGAMMA2 that are adjusted according to the calculated on-pixel ratio of the input data from the gamma voltage generator 350, and may receive the RGBW data as the image data from the data converter 310 via the timing controller 320. The source driver 340 may drive the RGBW sub-pixels by using the first and second gamma voltages VGAMMA1 and VGAMMA2 that are adjusted according to the calculated on-pixel ratio of the input data. Accordingly, even if the on-pixel ratio is changed, the organic light emitting display device 300 according to example embodiments may allow the RGB sub-pixels and the W sub-pixel to have substantially the same luminance at the changed on-pixel ratio, thereby preventing or reducing the simultaneous contrast phenomenon and improving the image quality.

Figure 7:
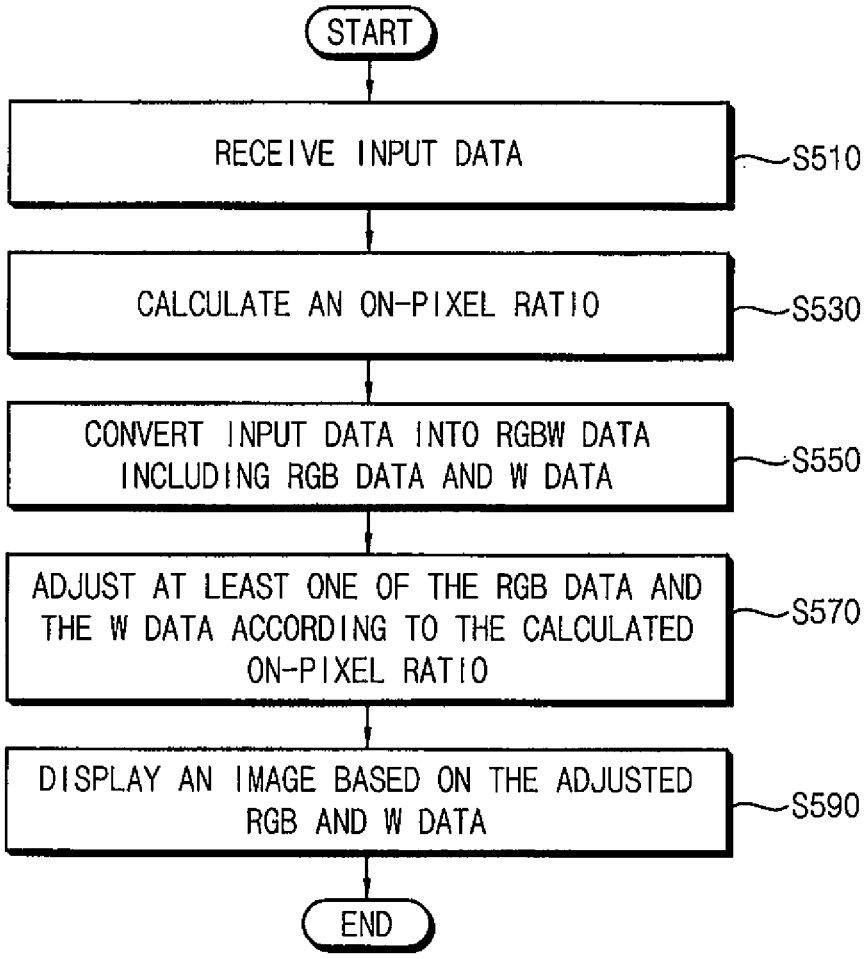
FIG. 7 is a flow chart illustrating a method of operating an organic light emitting display device including red, green, blue, and white sub-pixels in accordance with example embodiments.
Figure 8A:
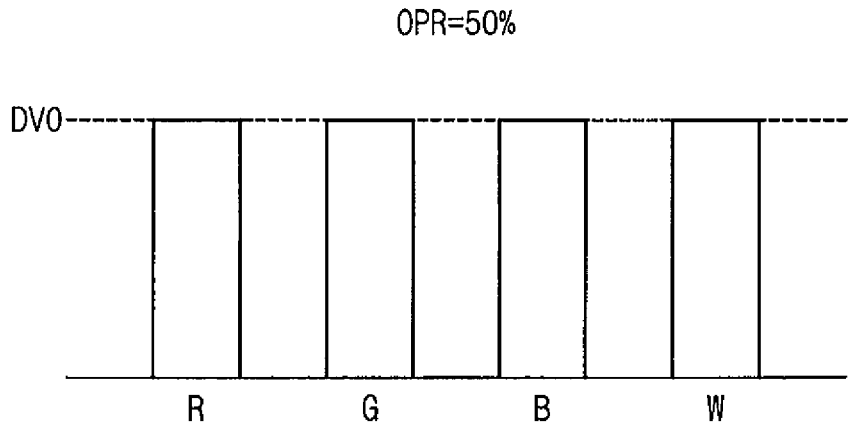
FIGS. 8A through 8C are diagrams for describing examples where input data are converted into RGBW data according to on-pixel ratios in a method of operating an organic light emitting display device in accordance with example embodiments.
Figure 8B:
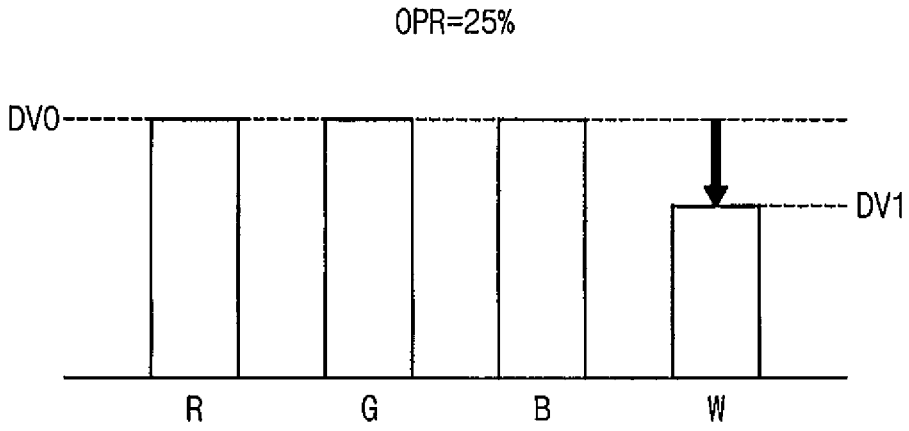
Figure 8C:
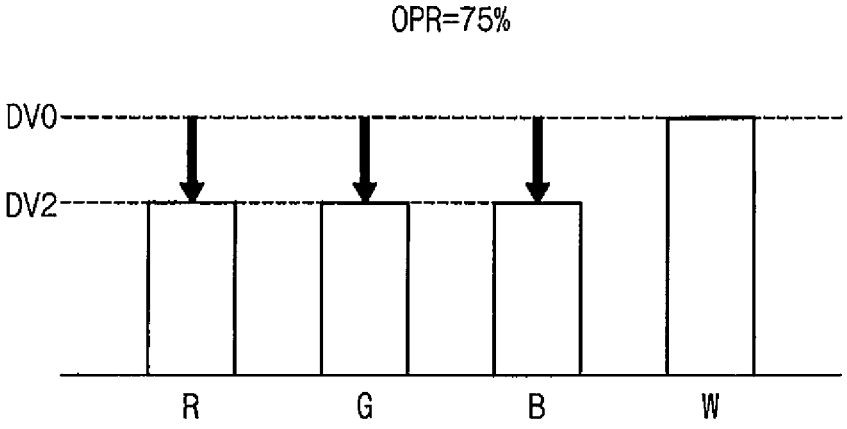

FIG. 7 is a flow chart illustrating a method of operating an organic light emitting display device including red, green, blue, and white sub-pixels in accordance with example embodiments, and FIGS. 8A through 8C are diagrams for describing examples where input data are converted into RGBW data according to on-pixel ratios in a method of operating an organic light emitting display device in accordance with example embodiments.

Referring to FIG. 7, in a method of operating an organic light emitting display device including a W sub-pixel as well as RGB sub-pixels, the organic light emitting display device receives input data (S510), and calculates an on-pixel ratio (OPR) of the input data (S530). Here, the on-pixel ratio of the input data may represent a ratio of a driving amount of the input data to the maximum driving amount, or a driving amount when all pixels included in the organic light emitting display device are driven at the highest gray level. In some example embodiments, the on-pixel ratio of the input data may be calculated per frame of the input data, or on a frame-by-frame basis.

The organic light emitting display device converts the input data into RGBW data including RGB data for the RGB sub-pixels and W data for the W sub-pixel (S550), and adjusts at least one data of the RGB data and the W data according to the calculated on-pixel ratio (S570). The at least one data may be adjusted such that, at the calculated on-pixel ratio, the RGB sub-pixels and the W sub-pixel have substantially the same luminance for the same gray level (e.g., such that the RGB sub-pixels and the W sub-pixel have a luminance difference of less than about 10%).

In some example embodiments, the RGB data may be decreased as the on-pixel ratio increases, and the W data may be decreased as the on-pixel ratio decreases. For example, a first gamma voltage for the RGB sub-pixels and a second gamma voltage for the W sub-pixel may be set such that, at a reference on-pixel ratio (e.g., a predetermined on-pixel ratio), for example, of about 50%, the RGB sub-pixels and the W sub-pixel have substantially the same luminance for the same gray level. However, if the on-pixel ratio is changed, the luminance of the RGB sub-pixels and the luminance of the W sub-pixel may be changed to have a difference due to a loading effect.

To obviate such a luminance difference, as illustrated in FIGS. 8A and 8B, when the on-pixel ratio decreases (e.g., from about 50% to about 25%), the organic light emitting display device according to example embodiments may decrease the W data from a first data value DV0 to a second data value DV1. Accordingly, even if the luminance of the RGB sub-pixels is relatively decreased compared with the luminance of the W sub-pixel as the on-pixel ratio decreases, the W data may be decreased, and thus the RGB sub-pixels and the W sub-pixel may have substantially the same luminance. Further, as illustrated in FIGS. 8A and 8C, when the on-pixel ratio increases (e.g., from about 50% to about 75%), the organic light emitting display device according to example embodiments may decrease the RGB data from a first data value DV0 to a second data value DV2. Accordingly, even if the luminance of the W sub-pixel is relatively decreased compared with the luminance of the RGB sub-pixels as the on-pixel ratio increases, the RGB data may be decreased, and thus the RGB sub-pixels and the W sub-pixel may have substantially the same luminance.

In some example embodiments, converting the input data into the RGBW data and adjusting at least one of the RGB data and the W data according to the calculated on-pixel ratio may be performed substantially concurrently (e.g., simultaneously).

In some example embodiments, when the input data are converted into the RGBW data, a ratio of the RGB data to the W data with respect to a white portion of the input data may be further adjusted based on a first accumulated driving amount of the RGB sub-pixels and a second accumulated driving amount of the W sub-pixel.

The organic light emitting display device displays an image based on the RGB data and the W data of which at least one is adjusted according to the calculated on-pixel ratio (S590).

As described above, in the method of operating the organic light emitting display device according to example embodiments, the on-pixel ratio of the input data may be calculated per frame, at least one of the RGB data and the W data may be adjusted according to the calculated on-pixel ratio, and the image may be displayed based on the adjusted RGB and W data. Accordingly, even if the on-pixel ratio is changed, the method of operating the organic light emitting display device according to example embodiments may allow the RGB sub-pixels and the W sub-pixel to have substantially the same luminance at the changed on-pixel ratio, thereby preventing or reducing the simultaneous contrast phenomenon and improving the image quality.

Figure 9:
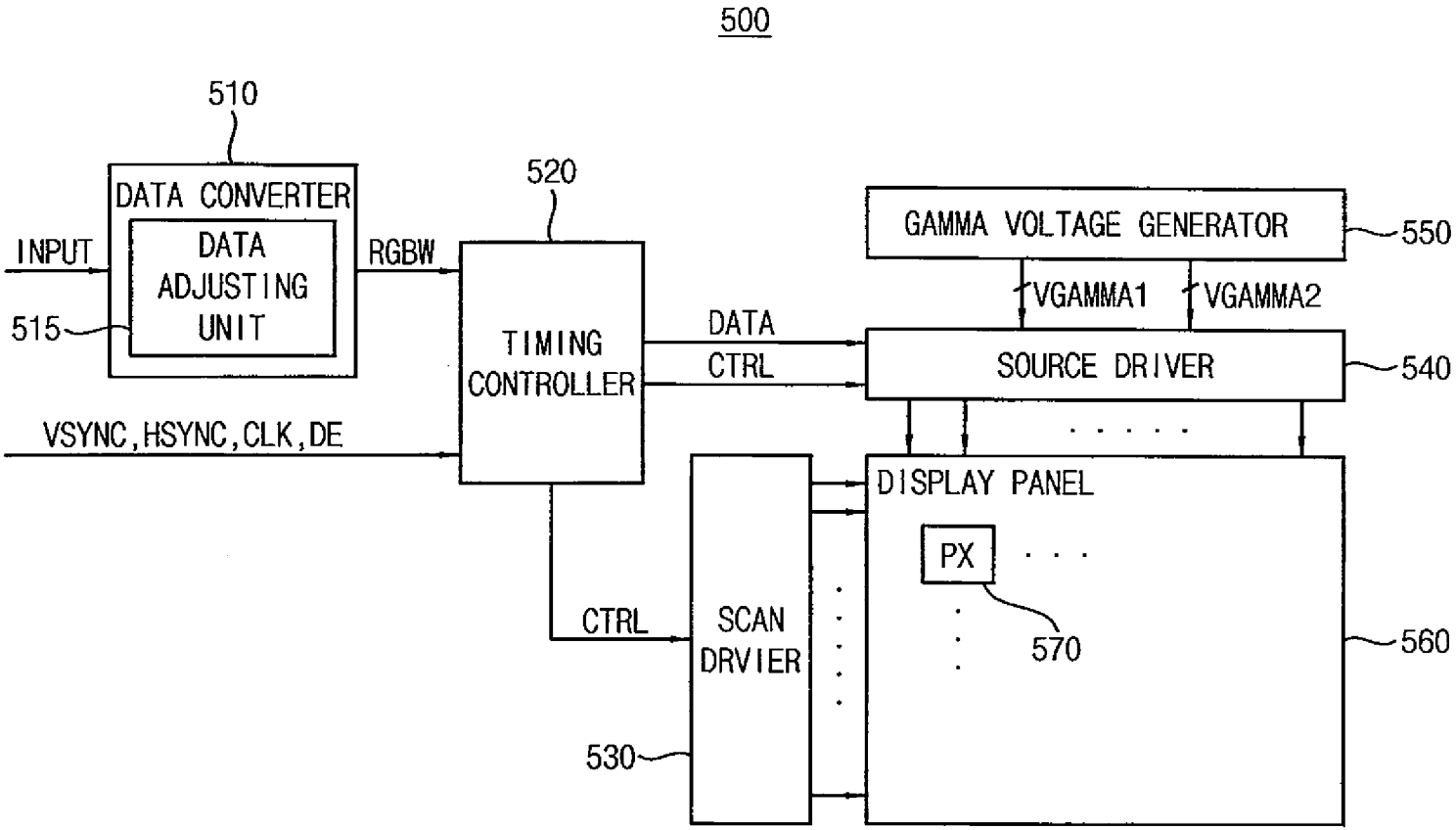
FIG. 9 is a block diagram illustrating an organic light emitting display device including red, green, blue, and white sub-pixels in accordance with example embodiments.

FIG. 9 is a block diagram illustrating an organic light emitting display device including red, green, blue, and white sub-pixels in accordance with example embodiments.

Referring to FIG. 9, an organic light emitting display device 500 includes a data converter 510, a timing controller 520, a scan driver 530, a source driver 540, a gamma voltage generator 550, and a display panel 560. The organic light emitting display device 500 of FIG. 9 may be similar to an organic light emitting display device 300 of FIG. 4, except that the data converter 510 includes a data adjusting unit 515 that adjusts RGB data and/or W data according to an on-pixel ratio.

The data converter 510 may receive input data INPUT, and may convert the input data into RGBW data including RGB data and W data. The data converter 510 may calculate an on-pixel ratio (OPR) representing a ratio of a driving amount of the input data INPUT to the maximum driving amount. In some example embodiments, the data converter 510 may calculate the on-pixel ratio of the input data on a frame-by-frame basis. Further, the data converter 510 may adjust at least one data of the RGB data and the W data according to the calculated on-pixel ratio by using the data adjusting unit 515. That is, the data adjusting unit 515 may adjust the at least one data such that, at the calculated on-pixel ratio, the RGB sub-pixels and the W sub-pixel have substantially the same luminance for the same gray level (e.g., such that the RGB sub-pixels and the W sub-pixel have a luminance difference lower than about 10%). For example, the data adjusting unit 515 may decrease the RGB data as the on-pixel ratio increases, and may decrease the W data as the on-pixel ratio decreases.

As described above, the organic light emitting display device 500 according to example embodiments may calculate the on-pixel ratio of the input data at each frame, and may adjust at least one of the RGB data and the W data according to the calculated on-pixel ratio. Accordingly, even if the on-pixel ratio is changed, the organic light emitting display device according to example embodiments may allow the RGB sub-pixels and the W sub-pixel to have substantially the same luminance at the changed on-pixel ratio, thereby preventing or reducing the simultaneous contrast phenomenon and improving the image quality.

Figure 10:
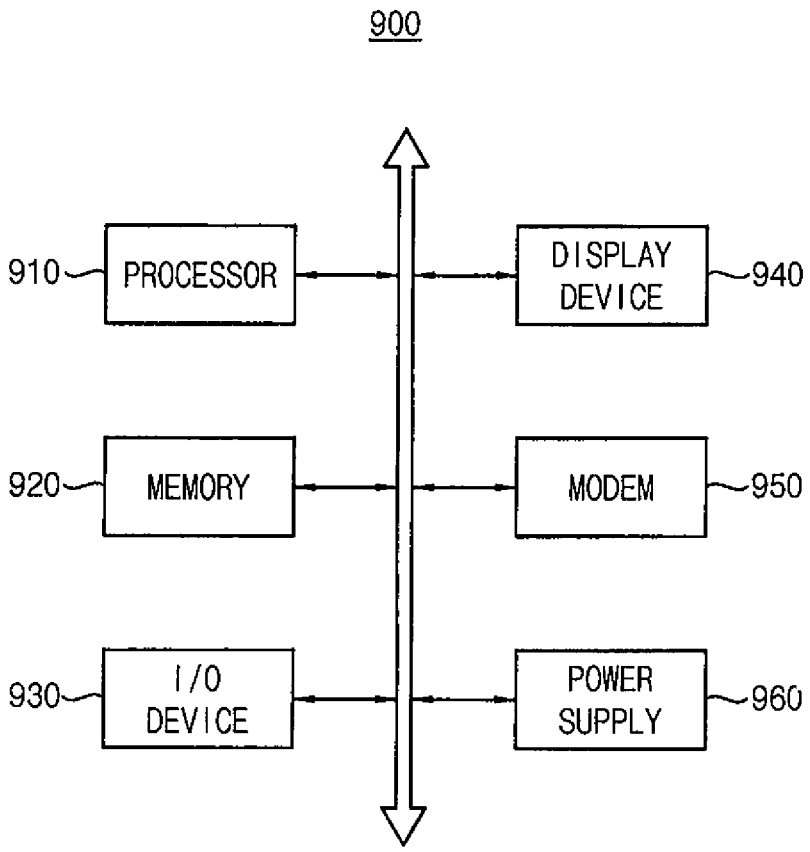
FIG. 10 is a block diagram illustrating an electronic device including an organic light emitting display device in accordance with example embodiments.

FIG. 10 is a block diagram illustrating an electronic device including an organic light emitting display device in accordance with example embodiments.

Referring to FIG. 10, an electronic device 900 includes a processor 910 and an organic light emitting display device 940. In some example embodiments, the electronic device 900 may further include a memory device 920, an input/output device 930, a modem 950, and a power supply 960.

The processor 910 may perform specific calculations or tasks. For example, the processor 910 may be a mobile system-on-chip (SOC), an application processor, a media processor, a microprocessor, a central process unit (CPU), a digital signal processor, or the like. The processor 910 may be coupled to the memory device 920 via an address bus, a control bus, and/or a data bus. For example, the memory device 920 may be implemented by a dynamic random access memory (DRAM), a mobile DRAM, a static random access memory (SRAM), a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc. Further, the processor 910 may be coupled to an extension bus, such as a peripheral component interconnect (PCI) bus. The processor 910 may control the input/output device 930 including an input device, such as a keyboard, a mouse, a keypad, etc., and an output device, such as a printer, a speaker, etc. via the extension bus.

The processor 910 may be further coupled to the organic light emitting display device 940. The organic light emitting display device 940 may allow RGB sub-pixels and a W sub-pixel to have substantially the same luminance by adjusting a gamma voltage and/or data according to an on-pixel ratio of input data, which may result in preventing or reducing the simultaneous contrast phenomenon and the improvement of the image quality.

Further, the processor 910 may control a storage device, such as a solid state drive, a hard disk drive, a CD-ROM, etc. via the extension bus. The modem 950 may perform wired or wireless communications with an external device. The power supply 960 may supply power to the electronic device 900. In some example embodiments, the electronic device 900 may further include an application chipset, a camera image processor (CIS), etc.

According to example embodiments, the electronic device 900 may be any electronic device including the organic light emitting display device 940, such as a digital television (TV), a 3D TV, a personal computer (PC), a home appliance, a laptop computer, a tablet computer, a cellular phone, a smart phone, a personal digital assistant (PDA), a portable multimedia player (PMP), a digital camera, a music player, a portable game console, a navigation device, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims, and their equivalents.

In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims, and their equivalents. The inventive concept is defined by the following claims, with equivalents of the claims to be included therein.

What is claimed is:

1. A method of operating an organic light emitting display device, the organic light emitting display device comprising a red sub-pixel, a green sub-pixel, a blue sub-pixel, and a white sub-pixel, the method comprising:

receiving input data;

calculating, on a frame-by-frame basis, an on-pixel ratio representing a ratio of a driving amount of the input data to a maximum driving amount;

adjusting at least one gamma voltage of a first gamma voltage for the red, green, and blue sub-pixels and a second gamma voltage for the white sub-pixel according to the calculated on-pixel ratio; and displaying an image corresponding to the input data using the first and second gamma voltages.

2. The method of claim 1, wherein the at least one gamma voltage is adjusted such that the red, green, and blue sub-pixels and the white sub-pixel have a same luminance for a same gray level at the calculated on-pixel ratio.

3. The method of claim 1, wherein, as the on-pixel ratio increases, the first gamma voltage is decreased, and wherein, as the on-pixel ratio decreases, the first gamma voltage is increased.

4. The method of claim 1, wherein, as the on-pixel ratio increases, the second gamma voltage is increased, and wherein, as the on-pixel ratio decreases, the second gamma voltage is decreased.

5. The method of claim 1, wherein, as the on-pixel ratio increases, the first gamma voltage is decreased, and the second gamma voltage is increased, and wherein, as the on-pixel ratio decreases, the first gamma voltage is increased, and the second gamma voltage is decreased.

6. The method of claim 1, wherein adjusting the at least one gamma voltage comprises:

storing a plurality of gamma voltage data respectively corresponding to a plurality of sections by dividing a range of the on-pixel ratio into the plurality of sections;

selecting one gamma voltage data corresponding to one of the sections to which the calculated on-pixel ratio belongs from among the plurality of gamma voltage data; and generating a gamma voltage corresponding to the selected one gamma voltage data as the adjusted at least one gamma voltage.

7. The method of claim 1, wherein displaying the image corresponding to the input data comprises:

converting the input data into RGBW data comprising RGB data for the red, green, and blue sub-pixels and W data for the white sub-pixel;

driving the red, green, and blue sub-pixels according to the RGB data based on the first gamma voltage; and driving the white sub-pixel according to the W data based on the second gamma voltage.

8. The method of claim 7, wherein converting the input data into the RGBW data comprises:

adjusting a ratio of the RGB data to the W data with respect to a white portion of the input data based on a first accumulated driving amount of the red, green, and blue sub-pixels and a second accumulated driving amount of the white sub-pixel.

9. A method of operating an organic light emitting display device, the organic light emitting display device comprising a red sub-pixel, a green sub-pixel, a blue sub-pixel, and a white sub-pixel, the method comprising:

receiving input data;

calculating, on a frame-by-frame basis, an on-pixel ratio representing a ratio of a driving amount of the input data to a maximum driving amount;

converting the input data into RGBW data comprising RGB data for the red, green, and blue sub-pixels and W data for the white sub-pixel;

adjusting at least one data of the RGB data and the W data according to the calculated on-pixel ratio; and displaying an image based on the RGB data and the W data.

10. The method of claim 9, wherein the at least one data is adjusted such that the red, green, and blue sub-pixels and the white sub-pixel have a same luminance for a same gray level at the calculated on-pixel ratio.

11. The method of claim 9, wherein, as the on-pixel ratio increases, the RGB data is decreased.

12. The method of claim 9, wherein, as the on-pixel ratio increases, the W data is decreased.

13. The method of claim 9, wherein the on-pixel ratio of the input data is calculated per frame.

14. An organic light emitting display device, comprising:

a display panel comprising a red sub-pixel, a green sub-pixel, a blue sub-pixel, and a white sub-pixel;

a data converter configured to receive input data, to convert the input data into RGBW data comprising RGB data for the red, green, and blue sub-pixels and W data for the white sub-pixel, and to calculate, on a frame-by-frame basis, an on-pixel ratio representing a ratio of a driving amount of the input data to a maximum driving amount;

a gamma voltage generator configured to generate a first gamma voltage for the red, green, and blue sub-pixels and a second gamma voltage for the white sub-pixel, and to adjust at least one gamma voltage of the first gamma voltage and the second gamma voltage according to the calculated on-pixel ratio; and a source driver configured to drive the red, green, blue, and white sub-pixels according to the RGBW data by using the first and second gamma voltages.

15. The organic light emitting display device of claim 14, wherein the gamma voltage generator is configured to adjust the at least one gamma voltage such that the red, green, and blue sub-pixels and the white sub-pixel have a same luminance for a same gray level at the calculated on-pixel ratio.

16. The organic light emitting display device of claim 14, wherein the gamma voltage generator is configured to decrease the first gamma voltage as the on-pixel ratio increases, and to increase the first gamma voltage as the on-pixel ratio decreases.

17. The organic light emitting display device of claim 15, wherein the gamma voltage generator is configured to increase the second gamma voltage as the on-pixel ratio increases, and to decrease the second gamma voltage as the on-pixel ratio decreases.

18. The organic light emitting display device of claim 14, wherein the gamma voltage generator comprises:

a gamma table configured to store a plurality of gamma voltage data respectively corresponding to a plurality of sections by dividing a range of the on-pixel ratio into the plurality of sections, and wherein the gamma voltage generator is configured to identify one section to which the calculated on-pixel ratio belongs among the plurality of sections, to read one gamma voltage data corresponding to the identified one section among the plurality of gamma voltage data from the gamma table, and to generate a gamma voltage corresponding to the read one gamma voltage data as the adjusted at least one gamma voltage.

* * * * *